US007479934B2

(12) United States Patent
Thebault et al.

(10) Patent No.: US 7,479,934 B2
(45) Date of Patent: Jan. 20, 2009

(54) REDUCTION OF PHOSPHOR LAG ARTIFACTS ON DISPLAY PANELS

(75) Inventors: Cédric Thebault, Villingen (DE); Sébastien Weitbruch, Mönchweiler (DE); Herbert Hoelzemann, Merkelbach (DE)

(73) Assignee: Thomson Licensing, Boulogne Billancourt (FR)

( * ) Notice: Subject to any disclaimer, the term of this patent is extended or adjusted under 35 U.S.C. 154(b) by 1080 days.

(21) Appl. No.: 10/424,895

(22) Filed: Apr. 28, 2003

(65) Prior Publication Data

US 2003/0210354 A1 Nov. 13, 2003

(30) Foreign Application Priority Data

May 7, 2002 (EP) ..... 02291161

(51) Int. Cl.
*G09G 3/28* (2006.01)

(52) U.S. Cl. ..... 345/60; 345/204

(58) Field of Classification Search ..... 345/690, 345/60–67, 76–77, 82–83, 204, 88–89, 692; 348/797, 630; 315/169.3
See application file for complete search history.

(56) References Cited

U.S. PATENT DOCUMENTS 6,014,258 A * 1/2000 Naka et al. ..... 359/618
6,025,818 A * 2/2000 Okano ..... 345/63
6,151,004 A * 11/2000 Kaneko ..... 345/88
6,377,232 B1 * 4/2002 Chevet et al. ..... 345/63
6,518,977 B1 * 2/2003 Naka et al. ..... 345/690
6,894,664 B2 * 5/2005 Thebault et al. ..... 345/60
6,977,629 B2 * 12/2005 Weitbruch et al. ..... 345/6
7,042,422 B2 * 5/2006 Weitbruch et al. ..... 345/63
7,064,731 B2 * 6/2006 Doyen et al. ..... 345/60
2004/0169732 A1 * 9/2004 Weitbruch et al. ..... 348/208.13
2005/0099366 A1 * 5/2005 Hoelzemann et al. ..... 345/72

FOREIGN PATENT DOCUMENTS

EP 0896317 A 2/1999
EP 0924684 A 6/1999
EP 0974953 A 1/2000
JP 08-211848 8/1996
JP 2001-255863 9/2001
JP 2002-14647 1/2002
WO WO 2007058448 A1 * 5/2007

OTHER PUBLICATIONS

Koichi Hamada et al.: "A Field-Sequential Display System wit 42-in. HDTV PDP and Improvement of Picture Quality by Cross-Talk Canceler," IEIC Technical Report (Institute of Electronics, Information and Communication Engineers), vol. 98, No. 549, p. 119-124(1999).

* cited by examiner

*Primary Examiner*—Ricardo L Osorio
(74) *Attorney, Agent, or Firm*—Joseph J. Laks; Harvey D. Fried; Richard LaPeruta

(57) ABSTRACT

Since the phosphor lag effect results from the slowness of the green and red phosphors and since it is not possible to make these phosphors faster, the blue one has to be made slower in order to reduce the color trail effect. Therefore, a part of the blue component is artificially delayed. Only a certain percentage of the blue component of the actual frame is transmitted during the actual frame, whereas the rest of the blue component will be transmitted during the next frames. The dynamic false contour effect introduced by this video processing may be compensated by subfield shifting.

15 Claims, 6 Drawing Sheets

REDUCTION OF PHOSPHOR LAG ARTIFACTS ON DISPLAY PANELS

The present invention relates to a method for processing video pictures for display on a display device having at least a first kind of luminous elements with a first time response and a second kind of luminous elements with a second time response being slower than the first time response by driving a luminous element of the first kind for one frame with a predetermined energy. Furthermore, the present invention relates to a corresponding device for processing video pictures.

BACKGROUND

As the old standard TV technology (CRT) has nearly reached its limits, some new display panels (LCD, PDP . . . ) are encountering a growing interest from manufacturers. Indeed, these technologies now make it possible to achieve flat color panel with very limited depth.

Referring to the last generation of European TV, a lot of work has been made to improve its picture quality. Consequently, the new technologies have to provide a picture quality as good as or better than standard TV technology. On the one hand, these new technologies give the possibility of flat screen, of attractive thickness, but on the other hand, they generate new kinds of artifacts, which could reduce the picture quality. Most of these artifacts are different as for TV picture and so more visible since people are used to seeing old TV artifacts unconsciously.

One of these artifacts is due to the different time responses of the three colors used in the panel. This difference generates a colored trail behind and in front the bright objects moving on a dark background mainly (or the opposite). In the case of plasma display panel (PDP), this artifact is known as "phosphor lag".

FIG. 1 shows the simulation of such a phosphor lag effect on a natural scene with a down shift. A green trail can be seen at the top edge of the trousers of the horseman.

Taking the case of plasma panels as an example, on a plasma panel, the three phosphors have not the same properties because of the chemical differences of the phosphors. In addition the life duration and the brightness are privileged at the expense of behaviour homogeneity.

The green phosphor G is the slowest, the blue one B is the fastest and the red one R is mostly in-between. Thus behind a white object in motion, there is a yellow-green trail (right-hand side of the white block of the "displayed picture" of FIG. 2), and in front a blue area (left-hand side of the white block of the "displayed picture" of FIG. 2), as can be seen in FIG. 2.

In the future, the development of new chemical phosphor powders could avoid such problems by making the green and red phosphors quicker. Nevertheless, today it is not possible by signal processing only to completely suppress this effect but one can try to make it less disturbing for a customer. The most cumbersome is not the trail but its color.

One known solution is to compensate the colored trail while modifying the blue component in the temporal domain in order to reduce the length of the trail.

One other solution is to add a complementary trail on the color trail in order to discolor it.

These two solutions need motion estimation as the solution presented in the present document.

INVENTION

It is the object of the present invention to provide a method and device for improving and simplifying the reduction of the color trail of moving objects on a display device.

According to the present invention this object is solved by a method for processing video pictures for display on a display device having at least a first kind of luminous elements with a first time response and a second kind of luminous elements with a second time response being slower than the first time response by driving a luminous element of said first kind for one frame with a predetermined energy, and driving said luminous element of said first kind in one frame period with a first part of said predetermined energy and in a following frame period with a second part of said predetermined energy.

Furthermore, the above-mentioned object is solved by a device for processing video pictures for display on a display device having at least a first kind of luminous elements with a first time response and a second kind of luminous elements with a second time response being slower than the first time response and driving means for driving a luminous element of said first kind for one frame with a predetermined energy, wherein said driving means enables driving said luminous element of said first kind in one frame period with a first part of said predetermined energy and in a following period with a second part of said predetermined energy.

Further favourable developments of the inventive device and method are defined in the subclaims. Especially, the luminous element of the first kind, e.g. blue element, may be driven in the one frame period and in the following frame periods with such amounts of energy that the temporal distribution of emitted energy of the luminous element of the first kind corresponds to the time response of the luminous element of the second kind (e.g. red or green element).

Since the phosphor lag is due to the slowness of the green and red phosphors and since it is not possible to make these phosphors faster, the blue component has to be made slower.

The phosphor lag artifact can be interpreted in term of energy: a part of the energy of the green and the red components is not transmitted during the present frame but during the next following frames. One can assume that there is a certain percentage of green and red energy, which is transmitted to the next frame. So a basic idea to make the blue phosphor as slow as the other ones is to do the same for the blue component: only a certain percentage of the blue component of the actual frame will be transmitted during the actual frame, whereas the rest of the blue component will be transmitted during the next frame.

Since this artificially delayed blue component is realized in a digital way (sub-field encoding) and not in an analog way like the real phosphor lag effect (for red and green), some artifacts will appear. These artifacts are well known in the plasma field as "false contour effects" and can be compensated by subfield shifting in order to obtain a blue with a similar behaviour (for the human eye) than the other colors.

DRAWINGS

Exemplary embodiments of the invention are illustrated in the drawings and are explained in more detail in the following description. In the drawings FIG. 1 shows an example of the phosphor lag effect;

EXEMPLARY EMBODIMENTS

Figure 1:
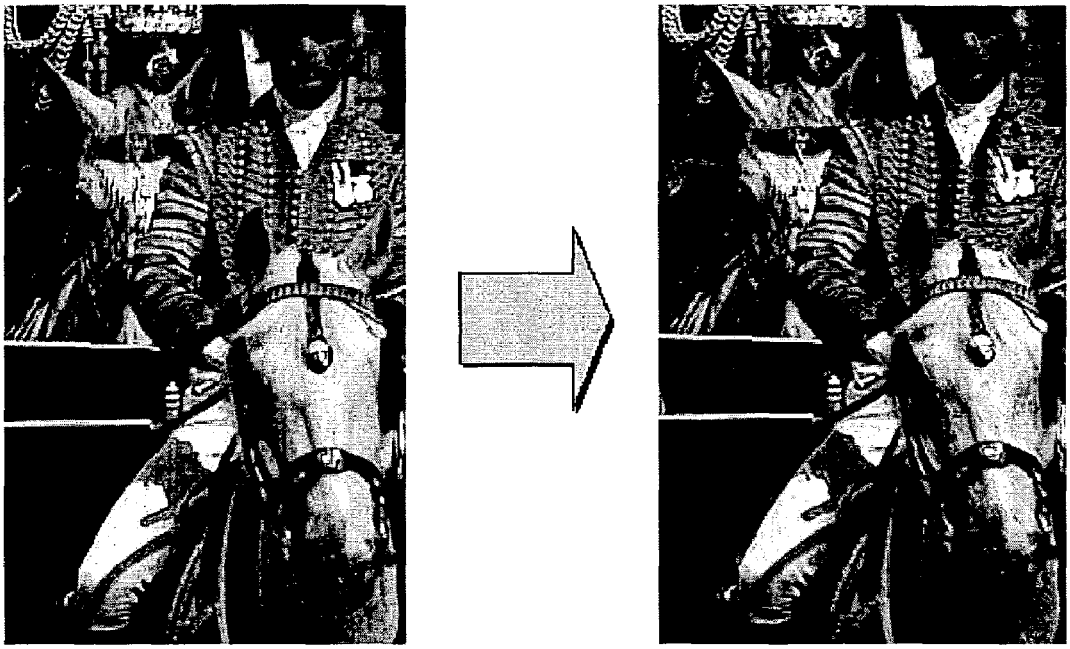
Figure 2:
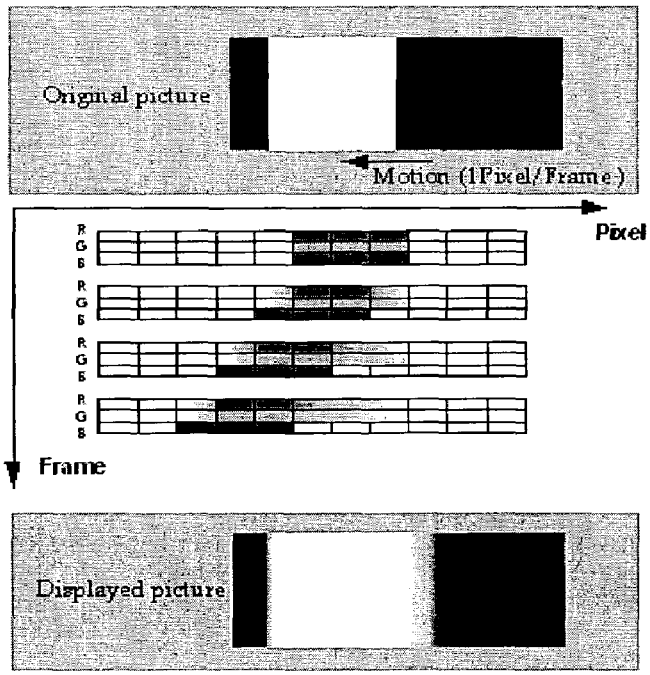
FIG. 2 shows a moving object with a yellow-green trail behind and a blue area in front of the object.
Figure 3:
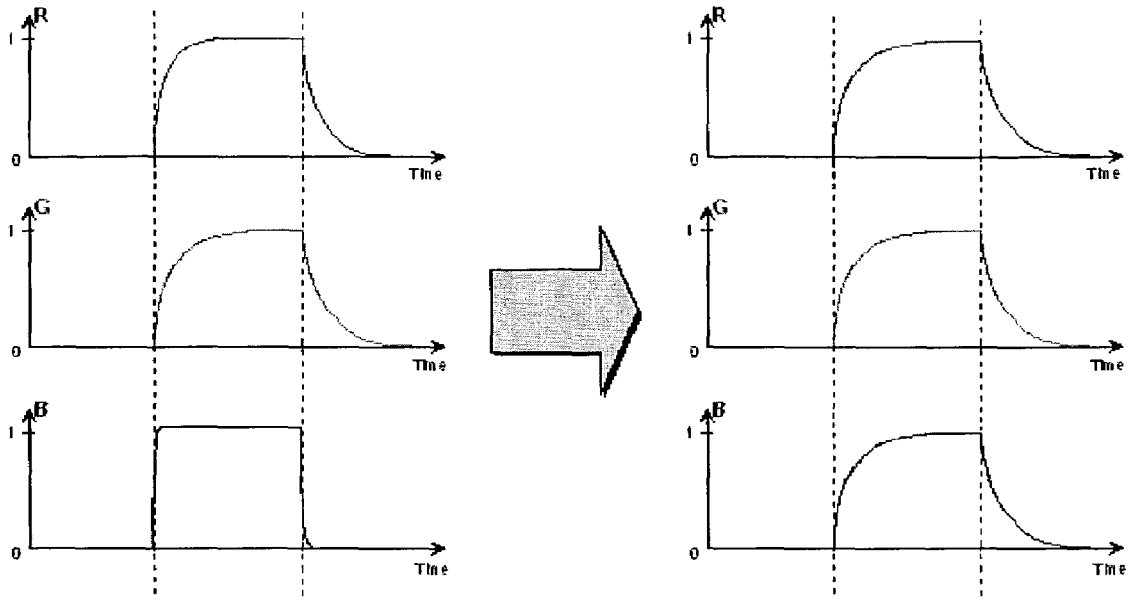
FIG. 3 shows the time responses of red, green and blue phosphor elements.

The phosphor lag problem mainly appears on strong edges of objects in motion, especially on bright to dark transition or the opposite, as described above. In the case of the PDP, the result is a kind of yellowish trail behind each bright to dark transition and a blue area in front of it. This is a result of the difference in the time responses of the phosphors. The idea of this invention is to make this artifact less disturbing for a customer by suppressing the unnatural color of the trail. As it is impossible to make the green phosphor G (the slowest) faster only by signal processing, the red R and the blue one B have to be made slower as depicted in FIG. 3.

As said above, the phosphor lag can be interpreted in term of energy: a part of the energy of the green and the red components is not transmitted during the present frame but during the next frames. One can assume that there is a certain percentage $\alpha$ (respectively $\beta$) of green G (respectively red R), which is transmitted on the next frame. $\alpha$ is superior to $\beta$ since the green phosphor lags more than the red one. The idea is to do the same for the blue component. So only $100-\alpha$ percent of the blue component of the actual frame roughly will be transmitted during the actual frame (roughly $100-\alpha+\beta$ percent of the red component can also be transmitted in order to discolor completely the trail). And a percent of the blue component of the actual frame will be transmitted during the next frame ($\alpha-\beta$ percent of the red component of the actual frame can also be transmitted in order to discolor completely the trail, as said previously). These modifications can be done at the video level, as just the video values are affected.

Figure 4:
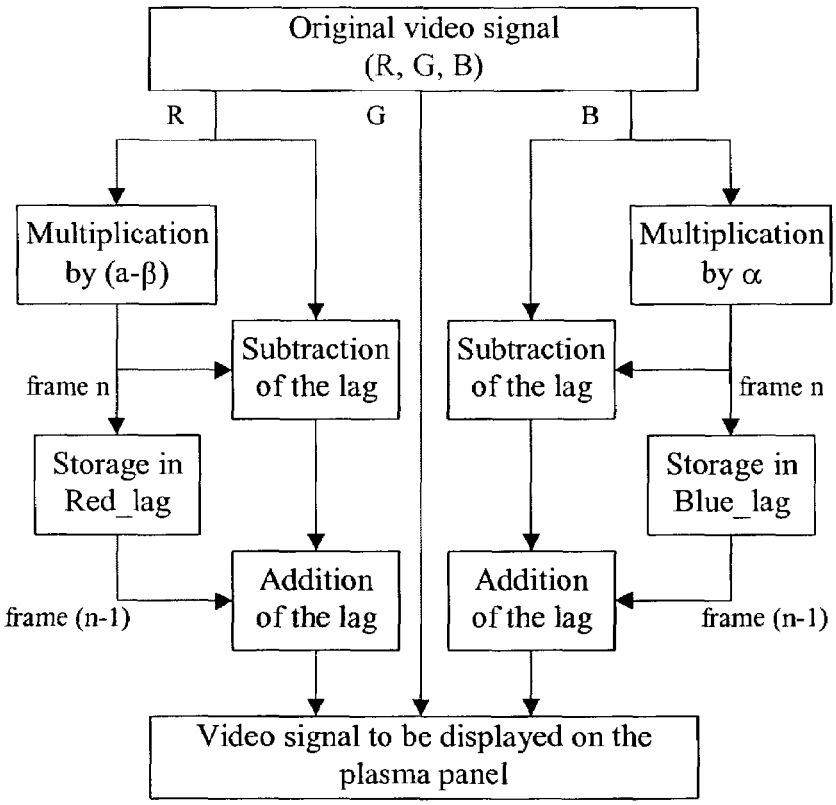
FIG. 4 shows a block diagram for processing the video signal.

As shown in FIG. 4, one or two monochrome pictures (depending whether red is lagged or not), blue_lag and red_lag for example, have to be used to store the lag picture ($\alpha$ percent of the blue component of the last frame n−1 and $\alpha-\beta$ percent of the red component of the last frame n−1).

For each frame n, the blue lag picture, blue_lag, (respectively the red lag picture, red_lag) obtained from the previous frame n−1 is added to $100-\alpha$ (respectively $100-\alpha+\beta$) percent of the original blue (respectively red) picture. The resulting picture is the one that will be displayed on the plasma display. Then $\alpha$ (respectively $\alpha-\beta$) of the original blue (respectively red) picture is stored in the lag picture, blue_lag (respectively red_lag).

The white box shifting on a black background by five pixels (compare FIG. 6) by frame as previously mentioned, shall be taken as example. When the pixels are switched on, the white pixels of the picture have the same value in the original video signal, but in order to have also a same video level on the screen (to obtain a perfect white), the next values have to be sent to the panels:

$255*(1-(\alpha-\beta)/100)$ for red
255 for green
$255*(1-\alpha/100)$ for blue When the pixel was already on, the white pixels take a new value:

$255*(1-(\alpha-\beta)/100)+255*(\alpha-\beta)/100=255$ for red
255 for green
$255*(1-\alpha/100)+255*\alpha/100=255$ for blue Finally when the pixels are switched off, the value of the formal white pixels is:

$255*(\alpha-\beta)/100$ for red
0 for green
$255*\alpha/100$ for blue

Figure 5:
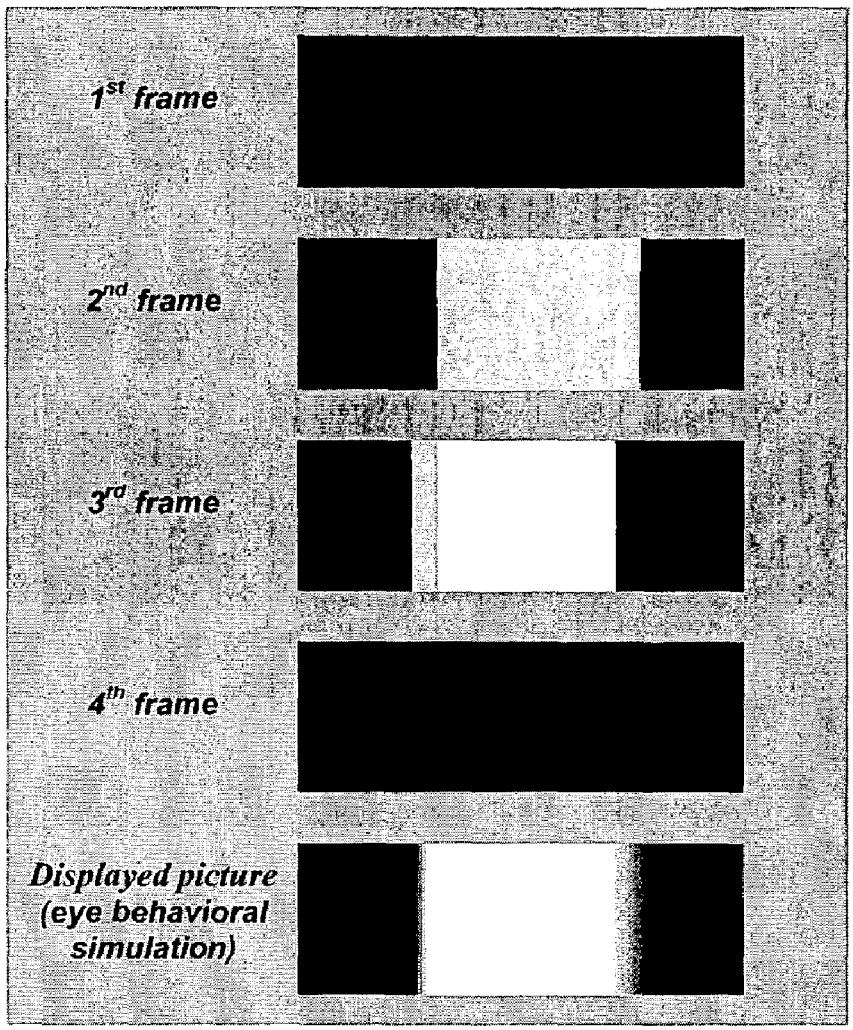
FIG. 5 shows the correction according to the processing of FIG. 4 generating a dynamic false contour effect.

According to the $1^{st}$ frame in FIG. 5, all the black pixels are really black (o for the three components). In the $2^{nd}$ frame of FIG. 5 there is shown a yellowish square resulting from the subtraction of the lag picture. In the $3^{rd}$ frame, the white square in the middle results from the present picture and the lag picture of the second frame. Since the square is moving, it has a yellowish front edge on the left side and a dark bluish edge on the right side. In the $4^{th}$ frame, there is a black picture to be displayed, but the stored lag picture is displayed which results in a bluish square. The eye will see the bottom picture of FIG. 5, i.e. a white square with a colored trail starting with a yellowish part and ending with a bluish part.

Figure 6:
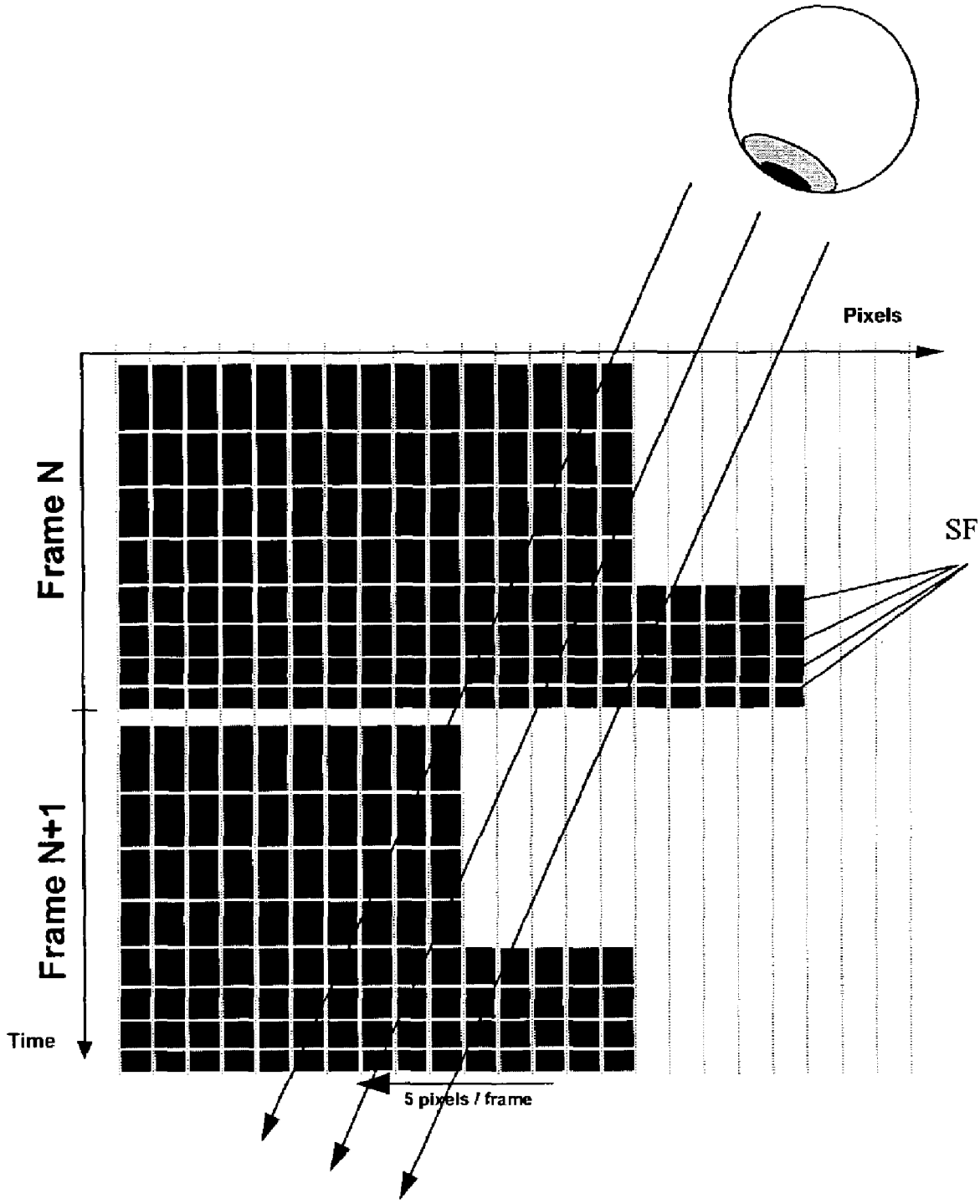
FIG. 6 shows a principle diagram for explaining the phosphor lag effect.

The behaviour of the human eye is explainable with FIG. 6. The problem is that the eye does not see directly the video level, but it follows the motion and integrates the light along the integration lines of FIG. 6 through the subfields SF of the frames. Therefore, in this case, the eye perceives a lack of luminance, and so the eye sees the trail due to phosphor lag, as a blue area at the transition of the bright and the dark part of the frame.

In fact, the problem is that the artificial remaining blue component for the lag picture is realized by digital means (sub-field encoding) and not in an anolog way like the real phosphor lag (red and green), so the classical artifact of PDP appears. This artifact is well known in the plasma field as "false contour effect".

Figure 7:
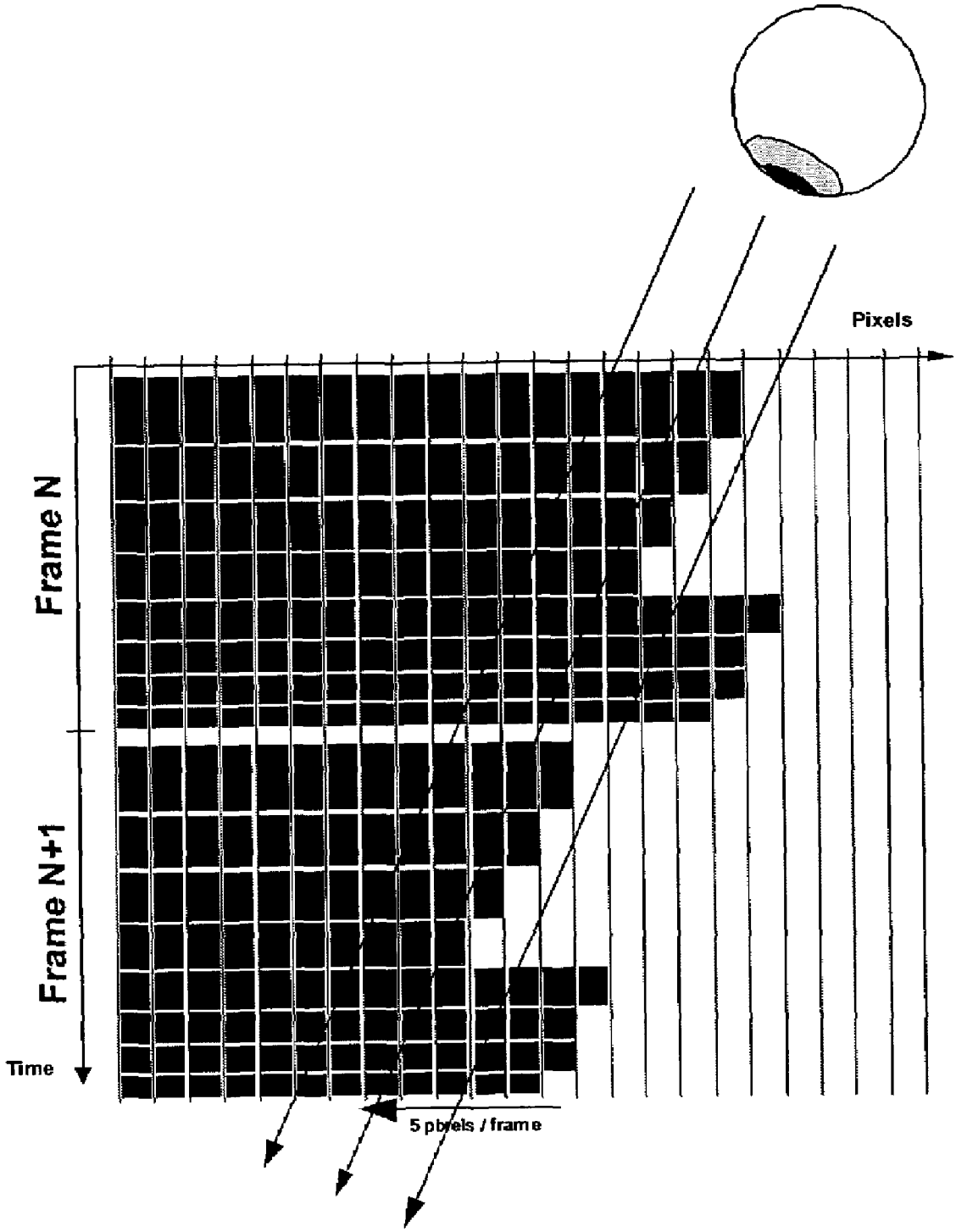
FIG. 7 shows a principle diagram for explaining the discolored trail of the phosphor lag effect.

This artifact can be reduced by using subfield shifting as proposed in the patent application PD 980054. FIG. 7 shows the result of the subfield shifting applied to the previous example.

As it can be seen, blue is added just on the transition, where the eye would perceive a lack of luminance, i.e. along the medium integration line.

Owing to this processing, the behaviour of the blue is equivalent for the human eye to the lag of the green and red phosphors.

So with this processing, the behaviour of the blue component is the same as that of the green and red components for the eye.

Figure 8:
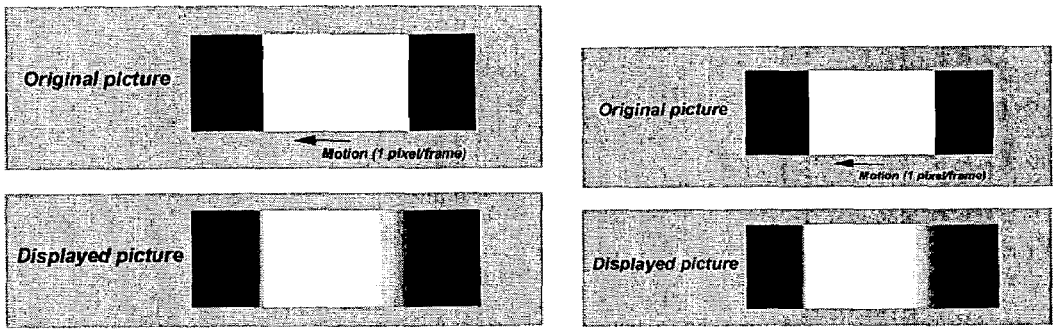
FIG. 8 shows a picture without compensation and a picture with compensation.

FIG. 8 illustrates the implementation of such an algorithm in the case of a white square moving on a black background. The displayed picture without compensation shows a colored trail, whereas the displayed picture with compensation shows a grey trail. The phosphor trail located behind and in front of the moving object has not change in terms of length but its unnatural colored aspect has disappeared, i.e. the trail has been discolored. With such a processing, the moving object looks like more natural for the customer's eye.

Subfield shifting is mostly used to compensate the dynamic false contour effect and also to enhance the sharpness. So if subfield shifting was already used, just the video processing has to be added.

Figure 9:
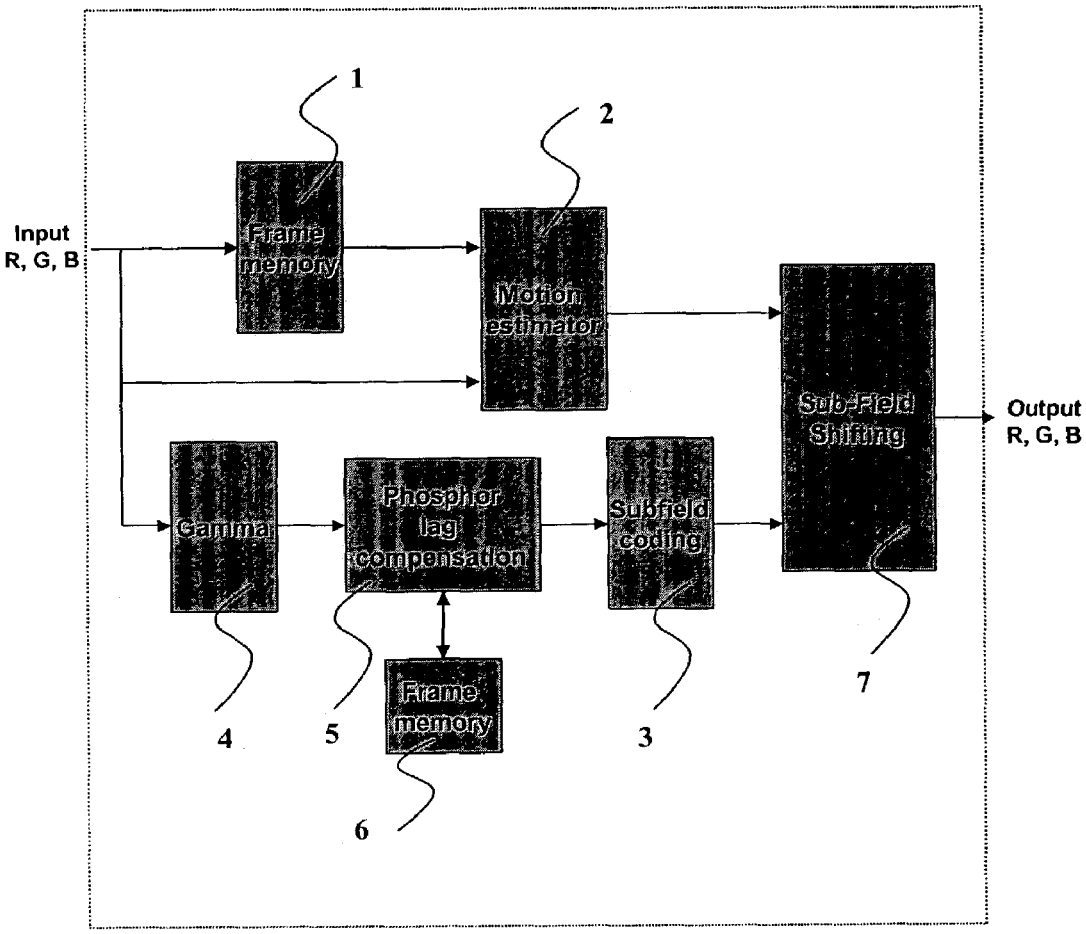
FIG. 9 shows a block diagram of an inventive device for processing video pictures.

An algorithm block diagram is shown in FIG. 9. Like in known applications, the red, green and blue signals R, G, B are input to a frame memory 1 as well as to a motion estimator 2. The motion estimator 2 also receives the output signal of the frame memory 1. Furthermore, the input signals R, G, B are used for subfield coding 3. For this, they are subjected to a gamma function 4 and a following inventive phosphor lag compensation 5. A frame memory 6 is connected to the phosphor lag compensation unit 5 in order to provide the respective lag pictures. The output of the phosphor lag compensation unit 5 is input to the subfield coding unit 3. A subfield shifting unit 7 forms an output signal from the signals obtained from the motion estimator 2 and the subfield coding unit 3.

In summary, the above-described invention has the following advantages:

It discolors the trails due to phosphor lag artifact and more generally to different time responses of the three colors used in a matrix panel.

A very simple implementation is possible.

It is very flexible because it can be adapted to any kind of phosphors or panels, wherein the percentage of green and red lags is completely variable.

Moreover, the present invention is applicable to all matrix displays based on sources presenting different time responses for the three colors and using a similar way of gray level rendition (pulse width modulation). In particular it is applicable to PDP, LCOS, etc.

What is claimed is:

1. Method for processing video pictures for display on a display device having at least a first kind of luminous elements with a first time response and a second kind of luminous elements with a second time response being slower than the first time response by driving a luminous element of said first kind for one frame with a predetermined energy, and driving said luminous element of said first kind in one frame with a first part of said predetermined energy and in a following frame with a second part of said predetermined energy.

2. Method according to claim 1, wherein the sum of the first and second part corresponds to the total predetermined energy.

3. Method according to claim 1, wherein said luminous element of the second kind is driven in said one frame with the same amount of predetermined energy, so that the same energy is emitted from said luminous elements of said first and second kind in said one frame.

4. Method according to claim 1, wherein the display device further includes a third kind of luminous elements with a third time response being slower than the second time response.

5. Method according to claim 4, wherein the first kind of luminous elements includes blue phosphor elements, the second kind red phosphor elements and the third kind green phosphor elements.

6. Method according to claim 1, wherein the display device includes a plasma display panel.

7. Method according to claim 1, wherein a factor between the first and second part of said predetennined energy is determined in advance and used for calculating a driving energy for each luminous element of said first kind.

8. Method according to claim 1, including the step of storing in a frame memory for all luminous elements of said first kind of one frame at least second parts of predetermined energies for displaying in a later frame.

9. Device for processing video pictures for display on a display device having at least a first kind of luminous elements with a first time response and a second kind of luminous elements with a second time response being slower than the first time response and driving means for driving a luminous element of said first kind for one frame with a predetermined energy, wherein said driving means enables driving said luminous element of said first kind in one frame with a first part of said predetermined energy and in a following frame with a second part of said predetermined energy.

10. Device according to claim 9, wherein the sum of the first and second parts of the predetermined energy corresponds to the total predetermined energy.

11. Device according to claim 9, including controlling means for driving said luminous element of said second kind in said one frame period with the same amount of said predetermined energy, so that the same energy is emitted from said luminous elements of said first and second kinds in said one frame.

12. Device according to claim 9, wherein said display device further includes luminous elements of a third kind with a third time response being slower than said second time response.

13. Device according to claim 12, wherein said first kind of luminous elements includes blue phosphor elements, said second kind includes red phosphor elements and said third kind includes green phosphor elements.

14. Device according to claim 9, wherein said display device includes a plasma display panel.

15. Device according to claim 9, further including a frame memory for storing for all luminous elements of said first kind of one frame at least second parts of predetermined energies for displaying in a later frame.

* * * * *